United States Patent [19]

Hradcovsky

[11] Patent Number: 4,659,440

[45] Date of Patent: Apr. 21, 1987

[54] METHOD OF COATING ARTICLES OF ALUMINUM AND AN ELECTROLYTIC BATH THEREFOR

[76] Inventor: Rudolf Hradcovsky, 27 W. Beach St., Long Beach, N.Y. 11561

[21] Appl. No.: 790,937

[22] Filed: Oct. 24, 1985

[51] Int. Cl.[4] ..... C25D 11/08

[52] U.S. Cl. ..... 204/58

[58] Field of Search ..... 204/58; 106/14.14

[56] References Cited

U.S. PATENT DOCUMENTS

| | | | |
|---|---|---|---|
| 3,812,021 | 5/1974 | Craig et al. | 204/58 |
| 3,812,022 | 5/1974 | Rogers et al. | 204/58 |
| 3,834,999 | 9/1974 | Hradcovsky et al. | 204/58 R |

*Primary Examiner*—R. L. Andrews

[57] ABSTRACT

An electrolytic bath for coating articles of aluminum and its alloys consists essentially of an aqueous solution containing an alkali metal silicate, a peroxide, a water-soluble carboxylic group-containing organic acid and a water-soluble fluoride. A vanadium compound may also be included in the bath whenever the coated articles are intended to be used for decorative purposes. In the process, the aluminum article is immersed in the bath and a voltage shock is applied thereto by imposing a voltage potential between the aluminum metal serving as the anode and a cathode immersed in the bath. The voltage potential is quickly raised to about 300 volts within about 2 to about 10 seconds and thereafter, the voltage is increased gradually to about 450 volts within a few minutes until the desired coating thickness is formed.

76 Claims, 3 Drawing Figures

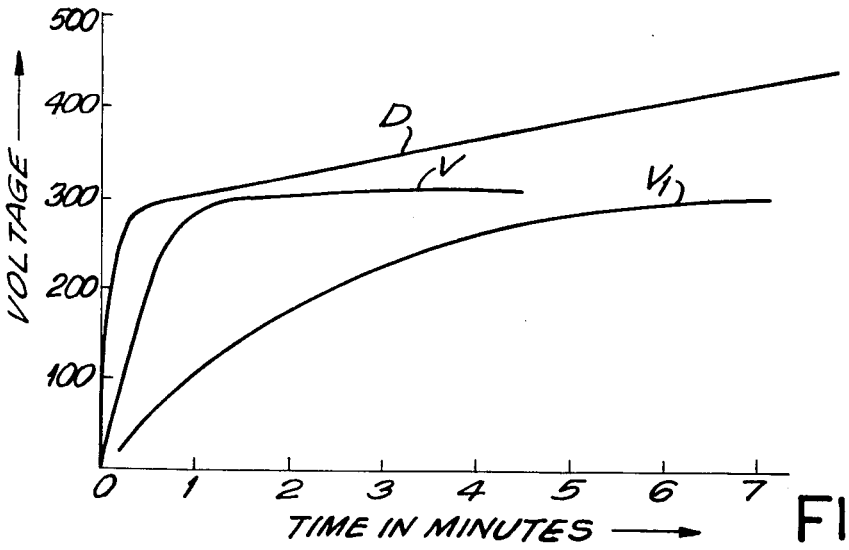
FIG.1
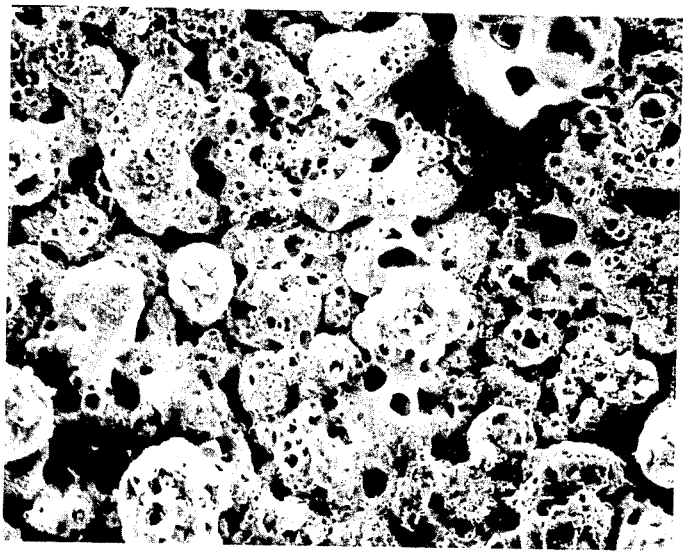
500x FIG.2
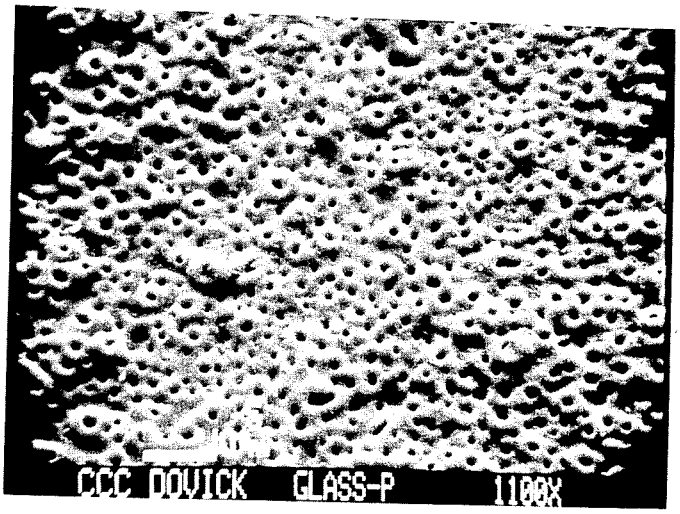
1100x FIG.3

METHOD OF COATING ARTICLES OF ALUMINUM AND AN ELECTROLYTIC BATH THEREFOR

FIELD OF THE INVENTION

This invention relates to a method of electrolytic coating of aluminum metal and its alloys. In one aspect, the present invention relates to an electrolytic method of coating aluminum and aluminum alloys to provide a hard, smooth, durable, impervious, adherent and corrosion-resistant film or coating thereon. In another aspect, the present invention is concerned with a method of providing a decorative electroplated film or finish on the surface of aluminum metal and its alloys, wherein the film is also hard, smooth, durable, impervious, adherent and corrosion-resistant. In still another aspect, this invention relates to an electrolytic bath which is uniquely suited for providing the aforementioned desired films or coatings on aluminum and its alloys.

BACKGROUND OF THE INVENTION

Aluminum and its alloys have found a variety of industrial and household applications in the form of sheets, strips, bars, rods, tubes, structural members, household appliances and utensils hardware and a host of other articles. See U.S. Pat. No. 2,941,930, issued on June 21, 1960 to Mostovych et al. As mentioned in said patent, there is great outlet for aluminum articles, including decorative products of this metal and its alloys, for such uses as ornamental wall panels for inside or outside of various buildings, restaurant furnishings, art objects and a host of other applications.

Because of its light weight and tendency toward surface corrosion, it has been necessary to provide a suitable coating on the surface of the metal in order to impart structural strength thereto and to protect it against corrosion and/or environmental degradation. Some protection has been afforded the metal by painting or enameling its surface. However, the protection afforded the metal by painting or enameling has not been satisfactory because such organic coatings degrade at high temperatures and frequently they adhere poorly to the metal surfaces, particularly when subjected to temperature variations.

In order to provide a more suitable coating for improved protection of aluminum metal and its alloys, the metal has been anodized in a variety of electrolytic solutions. While anodization of aluminum affords the metal surface a more effective protective coating against corrosion or degradation than painting or enameling, still the resulting coated metal has not always been satisfactory in that it is not entirely resistant against corrosion by many acids or alkalis. Moreover, the coatings imparted to the metal by the known electrodeposition methods often lack the desired degree of hardness, smoothness, durability, adherence and/or imperviousness required to meet the ever-increasing industrial and household demands. Frequently, too, the coated aluminum articles have not been satisfactory for use as decorative articles because of the poor quality or appearance of the surface coating.

There is a plethora of prior art patents which deal with anodizing aluminum metal and its alloys. The following is a list of patents which is representative of the efforts of the prior art workers in this field: U.S. Pat. Nos. 630,246; 1,735,286; 2,231,086; 2,260,278; 2,349,083; 2,363,339; 2,780,591; 2,791,553; 2,941,930; 3,003,933; 3,275,537; 3,355,368; 3,445,349; 3,532,607; 3,672,964; 3,899,400; 3,996,115; 4,113,579; 4,128,461; 4,170,525; 4,440,606; and 4,502,925. While this list is by no means exhaustive, a review of these patents illustrate the significant role which the electrolytic solution plays in the anodizing process and in providing aluminum and its alloys with the desired protective coating. Thus, in general, the nature and properties of the coating which is formed on aluminum and it alloys depend, to great extent, on the composition of the anodic bath (electrolytic solution) used in anodizing the metal. Other parameters such as the process conditions used during the electrodeposition also contribute to the nature and quality of the coating. Indeed, the present inventor recognized and discussed the significance of the electrolytic solution in the formation of suitable coatings on metals in his U.S. Pat. No. 4,082,626 which issued on Apr. 4, 1978. As mentioned in that patent, a rectifier metal is anodized by a relatively low voltage electrodeposition process in an electrolytic solution consisting of a relatively pure potassium silicate at concentrations exceeding the potassium silicate concentrations theretofore employed. The process comprised immersing a rectifier metal (e.g., aluminum) in the electrolyte, the rectifier metal serving as the anode, immersing a second metal in said electrolyte, said second metal being cathodic relative to the rectifier metal, imposing a voltage potential across the anode and the cathode and causing a current to flow therebetween until a visible spark is discharged at the surface of the rectifier metal, increasing the voltage potential to about 300 volts and maintaining the voltage substantially at this level until the desired coating thickness is deposited on the surface of the rectifier metal.

While the coating produced by the method described in the aforementioned patent exhibits some improvement and more desirable features as compared to the coatings produced by the earlier methods, they still do not completely fulfill the diverse and often stringent demands of various industrial and household requirements. Moreover, the surface finish of the metal is not entirely satisfactory for decorative applications of the coated metallic articles.

Accordingly, it is an object of this invention to protect the surface of aluminum metal and its alloys from corrosion and environmental attack and consequent degration.

It is a further object of this invention to protect the surfaces of aluminum metal and its alloys with a hard, uniform, adherent, smooth, impervious and corrosion-resistant coating.

It is yet another object of this invention to provide such coated articles of aluminum and its alloys which are useful for decorative applications.

It is also an object of this invention to provide an improved method for anodic coating of the surfaces of aluminum metal and its alloys.

It is still an object of this invention to provide the desired coating on the surfaces of aluminum metal and its alloy by a method which requires a relatively short time and relatively high voltage.

It is yet another object of this invention to provide a uniquely electrolytic solution for anodic coating of aluminum metal and its alloys.

It is still another object of this invention to provide an electrolytic solution which is a stable composition and which can withstand the relatively high voltage potential imposed during the electrodeposition process.

The foregoing and other unique features of the electrolytic solution and the process of this invention will be further described in, and more readily appreciated from, the ensuring detailed description and the accompanying drawings.

SUMMARY OF THE INVENTION

The objects of this invention are achieved by providing a unique electrolytic solution comprising certain specified ingredients designed to form a stable anodic bath, improve the electrodeposition process and form a unique coating on aluminum or its alloys. The coating formed on the metal is characterized, inter alia, by its highly adherent property, hardness, smooth texture, uniformity, corrosion-resistant and decorative appearance. The anodic bath is an aqueous solution comprising a silicate, peroxide, water-soluble carboxylic group-containing acid and water-soluble fluoride. When it is intended to use the coated article for decorative purposes, a vanadium compound is included in the solution. The bath ingredients react synergistically to form a complex stable solution, particularly under the process conditions used herein. In addition, the ingredients of the bath form a unique complex coating on the metal surface.

The electrolytic process comprises immersing the aluminum metal in the bath, in which aluminum serves as the anode. A second metal which is cathodic with respect to aluminum is also immersed in the bath. Alternatively, the bath is placed in a container which itself is cathodic relative to the aluminum metal. A voltage "shock" is then applied to the aluminum metal by imposing a voltage potential between the two electrodes, which is quickly raised to about 300 volts within about 2 to about 10 seconds. Thereafter, the voltage is increased gradually to about 450 volts within a few minutes to form the desired coating thickness.

BRIEF DESCRIPTION OF THE DRAWING

FIG. 1 depicts a series of graphs of the voltage potential applied to the electrodes as a function of the time required for electrolytic coating of aluminum. The significance of these graphs will become apparent from the ensuing discussion;

FIG. 2 is a photograph depicting a typical aluminum coated surface, with a degree of magnification of 500, produced according to the method described in the aforementioned Hradcovsky patent; and FIG. 3 is a photograph, magnified 1100 times, illustrating a coated aluminum surface produced by the method of this invention

DETAILED DESCRIPTION OF THE INVENTION

In accordance with the present invention, there is provided a unique electrolytic solution, sometimes referred to as an electrolytic bath or anodic bath, which is, inter alia, stable, particularly at the high voltages employed during the electrodeposition process, and which under the electrolytic process conditions of the present invention, imparts the desired coating to the surface of aluminum metal or alloys of aluminum which predominate in aluminum Accordingly, the terms "aluminum" or "aluminum metal" as used throughout the present specification and claims are intended to denote not only aluminum but such alloys as well.

As it was previously noted, there is a plethora of electrolytic solutions or anodic baths which have heretofore been employed for anodic coating of aluminum. The different baths frequently differ from one another with respect to only one or two ingredients. Nevertheless, and in view of the often unpredictable behavior of some chemicals, particularly when they are in admixture with other chemicals, the resulting electrolytic solutions exhibit marked differences in properties and abilities to impart coatings on metal surfaces. Frequently, too, the coatings imparted to the metal surfaces will exhibit significant differences in properties or constitution which reflect the differences in composition of the electrolytic solution. Therefore, the selection of the ingredients used to form the electrolytic solution is of paramount significance in the anodic treatment of metals.

A. The Electrolytic Solution

In order to protect the aluminum surface with a coating having the unique features and properties which were mentioned previously, and after extensive experimentations, it has been found that the most effective electrolytic solution for the purposes of this invention is an aqueous solution containing a silicate, a peroxide, a water-soluble organic acid, e.g., acetic acid, hydroflouric acid or a fluoride and a vanadate. It is believed that the synergistic interaction of these ingredients results in an electrolytic solution which, inter alia, (1) is a highly stable complex solution under the electrodeposition conditions of this invention and (2) imparts a unique coating on the surface of aluminum and renders the coated aluminum particularly useful for many industrial and household applications, including decorative applications.

Thus, and by way of illustration, a suitable electrolytic bath will contain potasium silicate ($K_2SiO_3$), sodium peroxide ($Na_2O_2$), acetic acid ($CH_3COOH$), hydrofluoric acid ($HF.H_2O$), sodium vanadate ($Na_3VO_4$) and water. As it can be appreciated certain other compounds may be used instead of, or together with, any of the aforementioned components.

While potassium silicate is the silicate of choice for forming the electrolytic bath, other alkali metal silicates can be used, including sodium silicate ($Na_2SiO_3$), lithium silicate ($Li_2SiO_3$), potassium tetrasilicate ($K_2SiO_4$), potassium fluosilicate ($K_2SiF_6$). Also, hydrofluosilicic acid may be used alone or in conjunction with any of the aforementioned silicates.

In lieu of sodium peroxide, or in admixture therewith, one could use other peroxides such as, for example, potassium peroxide, lithium peroxide or cesium peroxide.

The inclusion of the fluoride in the bath constitutes an essential feature of the present invention. While hydrofluoric acid is the preferred fluoride, other water-soluble fluorides such as, for example, fluosilicic acid, sodium fluoride, potassium fluoride or lithium fluoride may be used instead of, or in conjunction with, hydrofluoric acid.

Another essential ingredient of the bath is acetic acid. The use of this acid not only permits adjusting the pH of the bath but also promotes formation of a complex with and among the other ingredients, thus resulting in a stable complex solution. In lieu of acetic acid, or in admixture therewith, one can use other organic carboxylic group-containing acids including pergonic acid ($C_8H_{17}COOH$), propionic acid ($C_2H_5COOH$), tartaric acid (CHOH COOH CHOH COOH) and other water-soluble organic acids.

Sodium vanadate is the bath ingredient responsible for imparting color to the resulting coating. Other vanadium compounds may also be efficaciously used for this purpose. These include hypovanadate $M_2(V_4O_9).H_2O$, e.g., sodium pyrovanadate ($Na_2V_2O_7$) and potassium metavanadate ($KVO_3$). Even some of the vanadium fluorides may be employed for imparting color to the coated aluminum surface Such fluorides include vanadium trifluoride ($VF_3.H_2O$), vanadium tetrafluoride ($VF_4$) and vanadium pentafluoride ($VF_5$). In addition to the aforementioned ingredients, one could use sodium molybdate ($Na_2WO_4$) or some of the other molybdates.

B. Preparation of the Electrolytic Solution

The preparation of the electrolytic solution or the anodic bath basically comprises, first, the addition of the silicate to water at about room temperature, or preferably lower. The silicate usually constitutes the dominant ingredient of the bath and the resulting coating as well. The silicate is added as a 30 Be' and various industrial grades silicates are available in this strength. For example, potassium silicate may be used as 30 Be' KASIL 88 solution available from Philadelphia Quartz Co., Philadelphia, Pa.

Next, the peroxide is added while agitating the solution, followed by the addition of glacial acetic acid (99.9% reagent which has been diluted with water in a ratio of 6:1 volumes of water to the acid). While the mixture is being agitated, hydroflouric acid (35% concentration diluted with water in a ratio of 6:1 volumes of water to the acid) is added to the mixture, followed by the addition of the vanadate.

For commercial operations, and as a practical matter, it is recommended that the resulting bath be diluted with sufficient quantity of water to produce from about 0.5 to about 2 Be' anodic bath solution. For commercial production purposes, if the anodic bath significantly exceeds 2 Be', the electrodes may be damaged or burn out due to large current density requirements. However, for laboratory and experimental operations, the anodic bath may be as high as 30 Be' without severe adverse impact on the electrodes.

It is also important to maintain the pH of the anodic bath at from about 10.5 to about 13, preferably at from about 11 to about 12. Accordingly, the amount of the acetic acid in the bath may be varied to adjust the pH to the optimum level.

In the aforedescribed method of preparing the electrolytic solution, the ingredients have been referred to generically for the sake of simplicity. It must be emphasized, however, that regardless of which silicate, peroxide, organic acid, etc., are used, the order of addition of the ingredients and preparation of the bath remains essentially the same.

The amounts of the various ingredients used to form the anodic bath can vary widely. Thus the amount of silicate (30 Be') can vary from about 1 to about 200 cubic centimeters per liter; the peroxide quantity is between about 1 to about 20 grams per liter; and the organic acid is usually added in sufficient quantity to adjust the pH to the desired level as aforesaid. Also, the quantity of hydrofluoric acid can vary from about 0.1 to about 30 cubic centimeters per liter and the vanadate is added in sufficient amounts to obtain the desired color depth in the coating. This amount is usually about 0.1 grams per liter or more depending on the desired color depth. It has been noticed that the resulting coating is generally gray at the lower vanadate concentrations, tending to be black and deeper in color as the amount of vanadate is progressively increased.

The following examples are typical anodic baths which are suitable in the practice of this invention:

| | |
|---|---|
| **Example 1** | |
| $K_2SiO_3$(1) | 10 $cm^3$ |
| $Na_2O_2$ | 3 grams |
| $CH_3COOH$(2) | 3 $cm^3$ |
| $HF.H_2O$(3) | 2 $cm^3$ |
| $Na_3VO_4$ | 1 gram |
| $H_2O$ | 1000 $cm^3$ |
| **Example 2** | |
| $K_2SiO_3$(1) | 20 $cm^3$ |
| $Na_2O_2$ | 3 grams |
| $CH_3COOH$(2) | 3 $cm^3$ |
| $HF.H_2O$(3) | 2 $cm^3$ |
| $Na_3VO_4$ | 0.5 grams |
| $H_2O$ | 1000 $cm^3$ |
| **Example 3** | |
| $K_2SiO_3$(1) | 25 $cm^3$ |
| $Na_2O_2$ | 5 grams |
| $CH_3COOH$(2) | 5 $cm^3$ |
| $HF.H_2O$(3) | 0.2 $cm^3$ |
| $Na_3VO_4$ | 0.1 grams |
| $H_2O$ | 1000 $cm^3$ |
| **Example 4** | |
| $K_2SiO_3$(1) | 5 $cm^3$ |
| $Na_2O_2$ | 2 grams |
| $CH_3COOH$(2) | 10 $cm^3$ |
| $HF.H_2O$(3) | 5 $cm^3$ |
| $Na_3VO_4$ | 0.2 grams |
| $H_2O$ | 1000 $cm^3$ |
| **Example 5** | |
| $K_2SiO_3$(1) | 100 $cm^3$ |
| $Na_2O_2$ | 3 grams |
| $CH_3COOH$(2) | 10 $cm^3$ |
| $HF.H_2O$(3) | 10 $cm^3$ |
| $Na_3VO_4$ | 0 grams |
| $H_2O$ | 1000 $cm^3$ |
| **Example 6** | |
| $K_2SiO_3$(1) | 50 $cm^3$ |
| $Na_2O_2$ | 10 grams |
| $CH_3COOH$(2) | 5 $cm^3$ |
| $HF.H_2O$(3) | 10 $cm^3$ |
| $Na_3VO_4$ | 10 grams |
| $H_2O$ | 1000 $cm^3$ |
| **Example 7** | |
| $K_2SiO_3$(1) | 20 $cm^3$ |
| $Na_2O_2$ | 5 grams |
| $CH_3COOH$(2) | 3 $cm^3$ |
| $HF.H_2O$(3) | 5 $cm^3$ |
| $Na_3VO_4$ | 0.5–10 grams |
| $H_2O$ | 1000 $cm^3$ |
| **Example 8** | |
| $K_2SiO_3$(1) | 50 $cm^3$ |
| $Na_2O_2$ | 10 grams |
| $CH_3COOH$(2) | 15 $cm^3$ |
| $HF.H_2O$(3) | 10 $cm^3$ |
| $Na_3VO_4$ | 0.5–10 grams |
| $H_2O$ | 1000 $cm^3$ |
| **Example 9** | |
| $K_2SiO_3$(1) | 150 $cm^3$ |
| $Na_2O_2$ | 15 grams |
| $CH_3COOH$(2) | 20 $cm^3$ |
| $HF.H_2O$(3) | 10 $cm^3$ |
| Naf | 10 grams |
| $Na_3VO_4$ | 1 grams |
| $H_2O$ | 1000 $cm^3$ |
| **Example 10** | |
| $K_2SiO_3$(1) | 60 $cm^3$ |
| $Na_2O_2$ | 7 grams |
| $CH_3COOH$(2) | 7 $cm^3$ |
| KF | 5 grams |
| $Na_4V_2O_7$ | 3 grams |
| $H_2O$ | 1000 $cm^3$ |
| **Example 11** | |
| $Na_2SiO_3$ | 50 $cm^3$ |

-continued

| | |
|---|---|
| $Na_2O_2$ | 7 grams |
| $CH_3COOH$ | 7 $cm^3$ |
| NaF | 5 grams |
| $Na_3VO_4$ | 3 grams |
| $H_2O$ | 1000 $cm^3$ |
| Example 12 | |
| $Li_2SiO_3$(1) | 40 $cm^3$ |
| $Na_2O_2$ | 7 grams |
| $CH_3COOH$(2) | 7 $cm^3$ |
| LiF | 5 grams |
| $Na_4V_2O_7$ | 3 grams |
| $H_2O$ | 1000 $cm^3$ |
| Example 13 | |
| $K_2SiO_3$(1) | 65 $cm^3$ |
| $Na_2O_2$ | 8 grams |
| $CH_3COOH$(2) | 7 $cm^3$ |
| NaF | 5 grams |
| $Na_3VO_4$ | 1 gram |
| $H_2O$ | 1000 $cm^3$ |
| Example 14 | |
| $H_2SiF_6$ | 40 $cm^3$ |
| $Na_2O_2$ | 15 grams |
| $CH_3COOH$(2) | 15 $cm^3$ |
| $HF.H_2O$(3) | 15 $cm^3$ |
| $Na_3VO_4$ | 0.7 grams |
| $H_2O$ | 1000 $cm^3$ |

(1)30 Be'.
(2)99.9% glacial reagent diluted with water in a ratio of 6 volumes of water to one volume of the acid.
(3)35% concentration diluted with water in a ratio of 6 volumes of water to one volume of the acid.

C. The Coating Process

The process of coating the surfaces of aluminum in the present invention is somewhat similar to the process described in the aforementioned Hradcovsky patent with several basic differences. In addition to the differences in the nature of the anodic bath, in the process of this invention the voltage applied to the electrodes is raised quickly, i.e., the metal is "shocked" to about 300 volts within about 2 to about 10 seconds, and thereafter, the voltage is increased gradually to about 450 volts over a period of about 5 to about 10 minutes to obtain the desired coating thickness.

Thus, the present coating process comprises immersing the aluminum article to be coated in the anodic bath in which the aluminum is made anodic with respect to a second metal immersed in said bath which serves as the cathode. Alternatively, the aluminum article may be immersed in a container containing the bath and the container itself serves as the cathode.

After the aluminum article and the second metal have been immersed in the electrolytic solution, an electric voltage potential is applied between the two electrodes and this voltage is quickly raised to about 300 volts within about 2 to 10 seconds, preferably within about 3 to about 5 seconds. Following this shock, the voltage is gradually increased to about 450 volts over a period of about 5 minutes to about 10 minutes to form the desired coating thickness. During the shock period, a high current density of about 100 amperes/sq.ft. is passed through the electrode. Subsequently, however, the current density is reduced to as low as about 10 to about 50 amperes/sq.ft. In general, however, the current density can vary depending on the composition of the electrolytic bath and the aluminum alloy where an alloy is employed.

At such high voltage levels, a visible spark is discharged across the aluminum surface which creates a thermal environment in which the constituents of the anodic bath unite chemically with the aluminum, as well as with other ingredients of the bath to form a highly adherent complexed coating having the unique characteristics hereinbefore described. The application of voltage shock as aforesaid also reduces the overall time and even the energy required to form the desired coating thickness.

Referring now to FIG. 1, the voltage-time graph for the process of this invention is designated as D. But for this graph, FIG. 1 is the same as FIG. 1 of the aforementioned Hradcovsky patent and, therefore, the disclosure of that patent is incorporated herein by reference. Thus, graph $V_1$ represents a voltage-time relationship for coatings produced at low prior art silicate concentrations, and V is a voltage-time relationship for the method described in the aforementioned Hradcovsky patent.

As seen from graph D in FIG. 1, the voltage applied across the electrodes in the present process rises rapidly and reaches about 300 volts within few seconds. This is to be contrasted with the considerably longer time required for the voltage potential to reach a similar level by the process of the aforementioned Hradcovsky patent, and even the longer times required by the other methods referred to in said patent.

D. The Coating

As it was mentioned earlier, a principal object of the present invention is to produce coated aluminum articles which are particularly suitable for decorative applications. Such applications mandate that the coating on the aluminum surface not only be hard, adherent, durable and corrosion-resistant, but must also be smooth, homogeneous and even-textured, with luster and color depth as required for many decorative purposes. With this objective in mind, the composition of the bath and the process conditions are carefully selected as aforesaid in order to obtain the desired coating.

The superior appearance of the coatings produced by the practice of this invention can be appreciated by reference to FIGS. 2 and 3. As it is noted from a comparison of these two photographs, the coating produced by the method of the present invention, using an anodic bath having the constitution of any of the baths described in Examples 1–14, supra, are more uniform, homogeneous and less pervious than the coating produced in accordance with the method described in the aforementioned Hradcovsky patent. Such differences in properties are of paramount significance in customer appeal and eventual saleability of the coated aluminum articles.

While not wishing to be bound by any structural theory or mechanism, it is believed that the coating produced by the present invention is a complex formed by the union of the different ingredients with each other as well as with aluminum oxide on the surface of aluminum. In all instances, however, the silicate usually constitutes the dominant component.

Also, while vanadates or vanadium fluoride is used for imparting color to the coated surface, the use of these components is not strictly necessary. Anodic bath compositions of the types hereinbefore described, and illustrated in the foregoing examples, can be employed except that the vanadium compound may be omitted therefrom (see Example 5). Such baths nevertheless produce coatings which are superior in appearance, i.e., homogeneity, surface uniformity, adherence to the metal and smoothness, than the prior art coatings. However, they may have more limited use for decorative purposes.

While the invention has heretofore been described and illustrated with certain degree of specificity, it is apparent to those skilled in the art that some changes and modifications may be made therein, either in the bath or in the electrodeposition process. Such changes and modifications are suggested by the present disclosure and are, therefore, within the scope and contemplation of this invention.

What is claimed is:

1. A method of coating aluminum and aluminum alloys predominating in aluminum with a hard, adherent, smooth, uniform and corrosion-resistant coating, which method comprises immersing the aluminum or its said alloy in an aqueous electrolytic solution comprising an alkali metal silicate, a peroxide, a water-soluble carboxylic group-containing organic acid and a water-soluble fluoride, said aluminum or its alloy serving as the anode, immersing a second metal in said electrolytic solution in which said second metal serves as the cathode, applying an electrical voltage potential between said electrodes, raising said voltage to about 300 volts within about 1 to about 5 seconds, and thereafter gradually raising said voltage to about 450 volts over a period of a few minutes until the desired coating thickness is formed.

2. A method as in claim 1 wherein said alkali metal silicate is selected from the group consisting of potassium silicate, sodium silicate, lithium silicate, potassium tetrasilicate, potassium fluosilicate and mixtures thereof.

3. A method as in claim 1 wherein said peroxide is selected from the group consisting of potassium peroxide, sodium peroxide, lithium peroxide, cesium peroxide and mixtures thereof.

4. A method as in claim 1 wherein said carboxylic group-containing organic acid is selected from the group consisting of acetic acid, pergonic acid, propionic acid, tartaric acid and mixtures thereof.

5. A method as in claim 1 wherein said fluoride compound is selected from the group consisting of hydrofluoric acid, fluosilicic acid, sodium fluoride, potassium fluoride, lithium fluoride and mixtures therof.

6. A method as in claim 1 wherein said bath is maintained at from about 0.5 to about 30 Be'.

7. A method as in claim 2 wherein said bath is maintained at about 0.5 to about 30 Be'.

8. A method as in claim 3 wherein said bath is maintained at about 0.5 to about 30 Be'.

9. A method as in claim 4 wherein said bath is maintained at about 0.5 to about 30 Be'.

10. A method as in claim 5 wherein said bath is maintained at about 0.5 to about 30 Be'.

11. A method of coating aluminum and aluminum alloys predominating in aluminum with a hard, adherent, smooth, uniform and corrosion-resistant coating, which method comprises immersing aluminum or its said alloy in an aqueous electrolytic solution in a container in which said aluminum or its said alloy serves as the anode and said container serves as the cathode, said aqueous electrolytic solution comprising an alkali metal silicate, a peroxide, a water-soluble carboxylic group-containing organic acid and a water-soluble fluoride, applying an electrical voltage potential between said electrodes, raising said voltage to about 300 volts within about 1 to about 5 seconds, and thereafter gradually raising said voltage to about 450 volts over a period of a few minutes until the desired coating thickness is formed.

12. A method as in claim 11 wherein said alkali metal silicate is selected from the group consisting of potassium silicate, sodium silicate, lithium silicate, potassium tetrasilicate, potassium fluosilicate and mixtures thereof.

13. A method as in claim 11 wherein said peroxide is selected from the group consisting of potassium peroxide, sodium peroxide, lithium peroxide, cesium peroxide and mixtures thereof.

14. A method as in claim 11 wherein said carboxylic group-containing organic acid is selected from the group consisting of acetic acid, pergonic acid, propionic acid, tartaric acid and mixtures thereof.

15. A method as in claim 11 wherein said fluoride compound is selected from the group consisting of hydrofluoric acid, fluosilicic acid, sodium fluoride, potassium fluoride, lithium fluoride and mixtures therof.

16. A method as in claim 11 wherein said bath is maintained at from about 0.5 to about 30 Be'.

17. A method as in claim 12 wherein said bath is maintained at about 0.5 to about 30 Be'

18. A method as in claim 13 wherein said bath is maintained at about 0.5 to about 30 Be'.

19. A method as in claim 14 wherein said bath is maintained at about 0.5 to about 30 Be'.

20. A method as in claim 15 wherein said bath is maintained at about 0.5 to about 30 Be'.

21. A method as in claim 1 wherein said aqueous electrolytic solution further includes a vanadium compound for imparting color to the coating.

22. A method as in claim 2 wherein said aqueous electrolytic solution further includes a vanadium compound for imparting color to the coating.

23. A method as in claim 3 wherein said aqueous electrolytic solution further includes a vanadium compound for imparting color to the coating.

24. A method as in claim 4 wherein said aqueous electrolytic solution further includes a vanadium compound for imparting color to the coating.

25. A method as in claim 5 wherein said aqueous electrolytic solution further includes a vanadium compound for imparting color to the coating.

26. A method as in claim 6 wherein said aqueous electrolytic solution further includes a vanadium compound for imparting color to the coating.

27. A method as in claim 7 wherein said aqueous electrolytic solution further includes a vanadium compound for imparting color to the coating.

28. A method as in claim 8 wherein said aqueous electrolytic solution further includes a vanadium compound for imparting color to the coating.

29. A method as in claim 9 wherein said aqueous electrolytic solution further includes a vanadium compound for imparting color to the coating.

30. A method as in claim 10 wherein said aqueous electrolytic solution further includes a vanadium compound for imparting color to the coating.

31. A method as in claim 11 wherein said aqueous electrolytic solution further includes a vanadium compound for imparting color to the coating.

32. A method as in claim 12, wherein said aqueous electrolytic solution further includes a vanadium compound for imparting color to the coating.

33. A method as in claim 13, wherein said aqueous electrolytic solution further includes a vanadium compound for imparting color to the coating.

34. A method as in claim 14 wherein said aqueous electrolytic solution further includes a vanadium compound for imparting color to the coating.

35. A method as in claim 15 wherein said aqueous electrolytic solution further includes a vanadium compound for imparting color to the coating.

36. A method as in claim 16 wherein said aqueous electrolytic solution further includes a vanadium compound for imparting color to the coating.

37. A method as in claim 17 wherein said aqueous electrolytic solution further includes a vanadium compound for imparting color to the coating.

38. A method as in claim 18 wherein said aqueous electrolytic solution further includes a vanadium compound for imparting color to the coating.

39. A method as in claim 19 wherein said aqueous electrolytic solution further includes a vanadium compound for imparting color to the coating.

40. A method as in claim 20 wherein said aqueous electrolytic solution further includes a vanadium compound for imparting color to the coating.

41. An electrolytic bath for forming a coating on the surface of aluminum and alumimun alloys predominating in aluminum, said electrolytic bath consisting essentially of an aqueous solution containing from about 1 to about 200 $cm^3$ per liter of an alkali metal silicate, from about 1 to about 20 grams per liter of a peroxide, from about 1 to about 30 $cm^3$ per liter of a water-soluble carboxylic group-containing organic acid and from about to about 30 $cm^3$ per liter of a water-soluble fluoride.

42. An electrolytic bath as in claim 41 wherein said alkali metal silicate is selected from the group consisting of potassium silicate, sodium silicate, lithium silicate, potassium tetrasilicate, potassium fluosilicate and mixtures thereof.

43. An electrolytic bath as in claim 41 wherein said peroxide is selected from the group consisting of potassium peroxide, sodium peroxide, lithium peroxide, cesium peroxide and mixtures thereof.

44. An electrolytic bath as in claim 41 wherein said water-soluble carboxylic group-containing acid is selected from the group consisting of acetic acid, pergonic acid, propionic acid, tartaric acid and mixtures thereof.

45. An electrolytic bath as in claim 41 wherein said fluoride is selected from the group consisting of hydrofluoric acid, fluosilicic acid, sodium fluoride, potassium fluoride, lithium fluoride and mixtures thereof.

46. An electrolytic bath as in claim 41 further including a vanadium compound for imparting color to the coating.

47. An electrolytic bath as in claim 42 further including a vanadium compound for imparting color to the coating.

48. An electrolytic bath as in claim 43 further including a vanadium compound for imparting color to the coating.

49. An electrolytic bath as in claim 44 further including a vanadium compound for imparting color to the coating.

50. An electrolytic bath as in claim 45 further including a vanadium compound for imparting color to the coating.

51. A method of coating aluminum and aluminum alloys predominating in aluminum with a hard, adherent, smooth, uniform and corrosion-resistant coating, which method comprises immersing the aluminum or its said alloy in an aqueous electrolytic solution comprising hydrofluosilicic acid, a peroxide, a water-soluble carboxylic group-containing organic acid and a water-soluble fluoride, said aluminum or its alloy serving as the anode, immersing a second metal in said electrolytic solution in which said second metal serves as the cathode, applying an electrical voltage potential between said electrodes, raising said voltage to about 300 volts within about 1 to about 5 seconds, and thereafter gradually raising said voltage to about 450 volts over a period of a few minutes until the desired coating thickness is formed.

52. A method as in claim 51 wherein said peroxide is selected from the group consisting of potassium peroxide, sodium peroxide, lithium peroxide, cesium peroxide and mixtures thereof.

53. A method as in claim 51 wherein said carboxylic group-containing organic acid is selected from the group consisting of acetic acid, pergonic acid, propionic acid, tartaric acid and mixtures thereof.

54. A method as in claim 51 wherein said fluoride compound is selected from the group consisting of hydrofluoric acid, sodium fluoride, potassium fluoride, lithium fluoride and mixtures therof.

55. A method of coating aluminum and aluminum alloys predominating in aluminum with a hard, adherent, smooth, uniform and corrosion-resistant coating, which method comprises immersing aluminum or its said alloy in an aqueous electrolytic solution in a container in which said aluminum or its said alloy serves as the anode and said container serves as the cathode, said aqueous electrolytic solution comprising hydrofluosilicic acid, a peroxide, a water-soluble carboxylic group-containing organic acid and a water-soluble fluoride, applying an electrical voltage potential shock between said electrodes, raising said voltage to about 300 volts within about 1 to about 5 seconds, and thereafter gradually raising said voltage to about 450 volts over a period of a few minutes until the desired coating thickness is formed.

56. A method as in claim 55 wherein said peroxide is selected from the group consisting of potassium peroxide, sodium peroxide, lithium peroxide, cesium peroxide and mixtures thereof.

57. A method as in claim 55 wherein said carboxylic group-containing organic acid is selected from the group consisting of acetic acid, pergonic acid, propionic acid, tartaric acid and mixtures thereof.

58. A method as in claim 55 wherein said fluoride compound is selected from the group consisting of hydrofluoric acid, fluosilicic acid, sodium fluoride, potassium fluoride, lithium fluoride and mixtures therof.

59. A method as in claim 51 wherein said aqueous electrolytic solution further includes a vanadium compound for imparting color to the coating.

60. A method as in claim 52 wherein said aqueous electrolytic solution further includes a vanadium compound for imparting color to the coating.

61. A method as in claim 53 wherein said aqueous electrolytic solution further includes a vanadium compound for imparting color to the coating.

62. A method as in claim 54 wherein said aqueous electrolytic solution further includes a vanadium compound for imparting color to the coating.

63. A method as in claim 55 wherein said aqueous electrolytic solution further includes a vanadium compound for imparting color to the coating.

64. A method as in claim 56 wherein said aqueous electrolytic solution further includes a vanadium compound for imparting color to the coating.

65. A method as in claim 57 wherein said aqueous electrolytic solution further includes a vanadium compound for imparting color to the coating.

66. A method as in claim 58 wherein said aqueous electrolytic solution further includes a vanadium compound for imparting color to the coating.

67. An electrolytic bath for forming a coating on the surface of aluminum and aluminum alloys predominating in aluminum, said electrolytic bath consisting essentially of an aqueous solution containing from about 1 to about 200 $cm^3$ per liter of hydrofluosilicic acid, from about 1 to about 20 grams per liter of a peroxide, from about 1 to about 30 $cm^3$ per liter of a water-soluble carboxylic group-containing organic acid and from about to about 30 $cm^3$ per liter of a water-soluble fluoride.

68. An electrolytic bath as in claim 67 wherein said peroxide is selected from the group consisting of potassium peroxide, sodium peroxide, lithium peroxide, cesium peroxide and mixtures thereof.

69. An electrolytic bath as in claim 67 wherein said water-soluble carboxylic group-containing acid is selected from the group consisting of acetic acid, pergonic acid, propionic acid, tartaric acid and mixtures thereof.

70. An electrolytic bath as in claim 67 wherein said fluoride is selected from the group consisting of hydrofluoric acid, sodium fluoride, potassium fluoride, lithium fluoride and mixtures thereof.

71. An electrolytic bath as in claim 67 further including a vanadium compound for imparting color to the coating.

72. An electrolytic bath as in claim 68 further including a vanadium compound for imparting color to the coating.

73. An electrolytic bath as in claim 69 further including a vanadium compound for imparting color to the coating.

74. An electrolytic bath as in claim 70 further including a vanadium compound for imparting color to the coating.

75. An electolytic bath for forming a coating on the surface of aluminum and aluminum alloys predominating in aluminum, said electrolytic bath consisting essentially of an aqueous solution of an alkali metal silicate, a peroxide, a carboxylic group-containing organic acid and a water-soluble fluoride.

76. An electrolytic bath as in claim 75 wherein said alkali metal silicate is selected from the group consisting of potassium silicate, potassium tetrasilicate, potassium fluosilicate and mixtures thereof; said peroxide is selected from the group consisting of potassium peroxide, sodium peroxide, lithium peroxide, cesium peroxide and mixtures thereof; said organic acid is selected from the group consisting of acetic acid, pergonic acid, propionic acid, tartaric acid and mixtures thereof, and said fluoride is selected from the group consisting of hydrofluoric acid, fluosilicic acid, sodium fluoride, potassium fluoride, lithium fluoride and mixtures thereof.

* * * * *